US009793643B2

(12) United States Patent
Whitacre

(10) Patent No.: US 9,793,643 B2
(45) Date of Patent: Oct. 17, 2017

(54) ELECTRICAL CONNECTOR HAVING A SEAL RETAINER

(71) Applicant: TYCO ELECTRONICS CORPORATION, Berwyn, PA (US)

(72) Inventor: Dennis Craig Whitacre, Rancho Cucamonga, CA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 56 days.

(21) Appl. No.: 14/978,343

(22) Filed: Dec. 22, 2015

(65) Prior Publication Data

US 2016/0211605 A1 Jul. 21, 2016

Related U.S. Application Data

(60) Provisional application No. 62/104,457, filed on Jan. 16, 2015.

(51) Int. Cl.
*H01R 13/52* (2006.01)

(52) U.S. Cl.
CPC ..... *H01R 13/5202* (2013.01); *H01R 13/5219* (2013.01)

(58) Field of Classification Search
CPC . H01R 13/52; H01R 13/5202; H01R 13/5219
USPC ..... 439/271–273, 277, 588–589
See application file for complete search history.

(56) References Cited

U.S. PATENT DOCUMENTS 4,834,676 A 5/1989 Tackett
7,850,487 B1 12/2010 Wei
2015/0118902 A1* 4/2015 Data ..... H01R 24/28 439/587

FOREIGN PATENT DOCUMENTS

WO 2011/059885 A1 5/2011

OTHER PUBLICATIONS

International Search Report, International Application No. PCT/US2015/012049, International Filing Date, Jan. 4, 2016.

* cited by examiner

*Primary Examiner* — Khiem Nguyen

(57) ABSTRACT

An electrical connector includes a shell having a cavity configured to receive a complementary connector. The shell has a front end and a rear end and a circumferential channel in the cavity. The channel has an undercut defined by a seal retention flange extending circumferentially around the channel. A seal retainer is received in the cavity at the front end. The seal retainer has a front edge and a rear edge received in the channel. The rear edge of the seal retainer has an undercut defined by a seal retention flange. The seal retention flange of the seal retainer faces the seal retention flange of the shell across the channel to define a seal pocket. An O-ring seal is received in the seal pocket and is held in the seal pocket by the seal retention flanges.

19 Claims, 5 Drawing Sheets

ELECTRICAL CONNECTOR HAVING A SEAL RETAINER

CROSS REFERENCE TO RELATED APPLICATIONS

This application claims the benefit of U.S. Provisional Application No. 62/104,457 filed Jan. 16, 2015 titled ELECTRICAL CONNECTOR HAVING A SEAL RETAINER, the subject matter of which is herein incorporated by reference in its entirety.

BACKGROUND OF THE INVENTION

The subject matter herein relates generally to an electrical connector having a seal retainer.

Electrical connectors typically have a housing that is molded or cast, such as injection molded or die-cast. Forming circumferential grooves or channels in the interior cavity of the housing is difficult and requires a collapsible core mold or die, which are complex and expensive. Collapsible core molds and dies have problems with flashing at the seams where the mold or die pieces meet. Flashing leads to many problems, including partially filling of the groove or channel space, which when such channel is used for holding an O-ring seal, may cause the O-ring seal to sit improperly in the channel. Additionally, forming the undercut using collapsible core is difficult and requires a complex and expensive mold or die.

BRIEF DESCRIPTION OF THE INVENTION

In one embodiment, an electrical connector is provided including a shell having a cavity configured to receive a complementary connector. The shell has a front end and a rear end. The shell has a circumferential channel in the cavity proximate to the front end. The channel has an undercut defined by a seal retention flange extending circumferentially around the channel. A seal retainer is received in the cavity at the front end of the shell. The seal retainer has a securing feature securing the seal retainer to the shell. The seal retainer has a front edge and a rear edge. The rear edge of the seal retainer is received in the channel. The rear edge of the seal retainer has an undercut defined by a seal retention flange. The seal retention flange of the seal retainer faces the seal retention flange of the shell across the channel to define a seal pocket. An O-ring seal is received in the seal pocket. The O-ring seal is held in the seal pocket by the seal retention flanges.

In another embodiment, an electrical connector is provided including a shell having a cavity configured to receive a contact assembly including at least one contact. The shell has a generally cylindrical cross-section and extends between a front end and a rear end. The shell has an internal channel in the cavity proximate to the front end. The internal channel has a circumferential outer wall along a radially outer side of the channel and a seal retention flange along a rear side of the channel. The seal retention flange is angled to define an undercut between the seal retention flange and the outer wall. A seal retainer is received in the cavity at the front end of the shell. The seal retainer has a securing feature securing the seal retainer to the shell. The seal retainer has a ring-shaped body extending to a rear edge. The rear edge is received in the channel such that the rear edge faces the seal retention flange across the channel to define a seal pocket. An O-ring seal is received in the seal pocket. The O-ring seal is held in the seal pocket by the rear edge and the seal retention flange.

In a further embodiment, an electrical connector is provided including a shell defining a rear receptacle housing extending between a front end and a rear end and a seal retainer defining a front receptacle housing. The rear receptacle housing has a cavity configured to receive a complementary connector. The rear receptacle housing has a generally cylindrical cross-section. The front receptacle housing is received in the cavity at the front end of the shell. The front receptacle housing has a securing feature securing the front receptacle housing to the rear receptacle housing. The front receptacle housing has a ring-shaped body extending to a rear edge. The rear receptacle housing and front receptacle housing form a seal pocket therebetween. The seal pocket is positioned radially outward of the cavity. The seal pocket has seal retaining flanges formed by undercuts. An O-ring seal is received in the seal pocket. The O-ring seal is held in the seal pocket by the seal retention flanges.

DETAILED DESCRIPTION OF THE INVENTION

Figure 1:
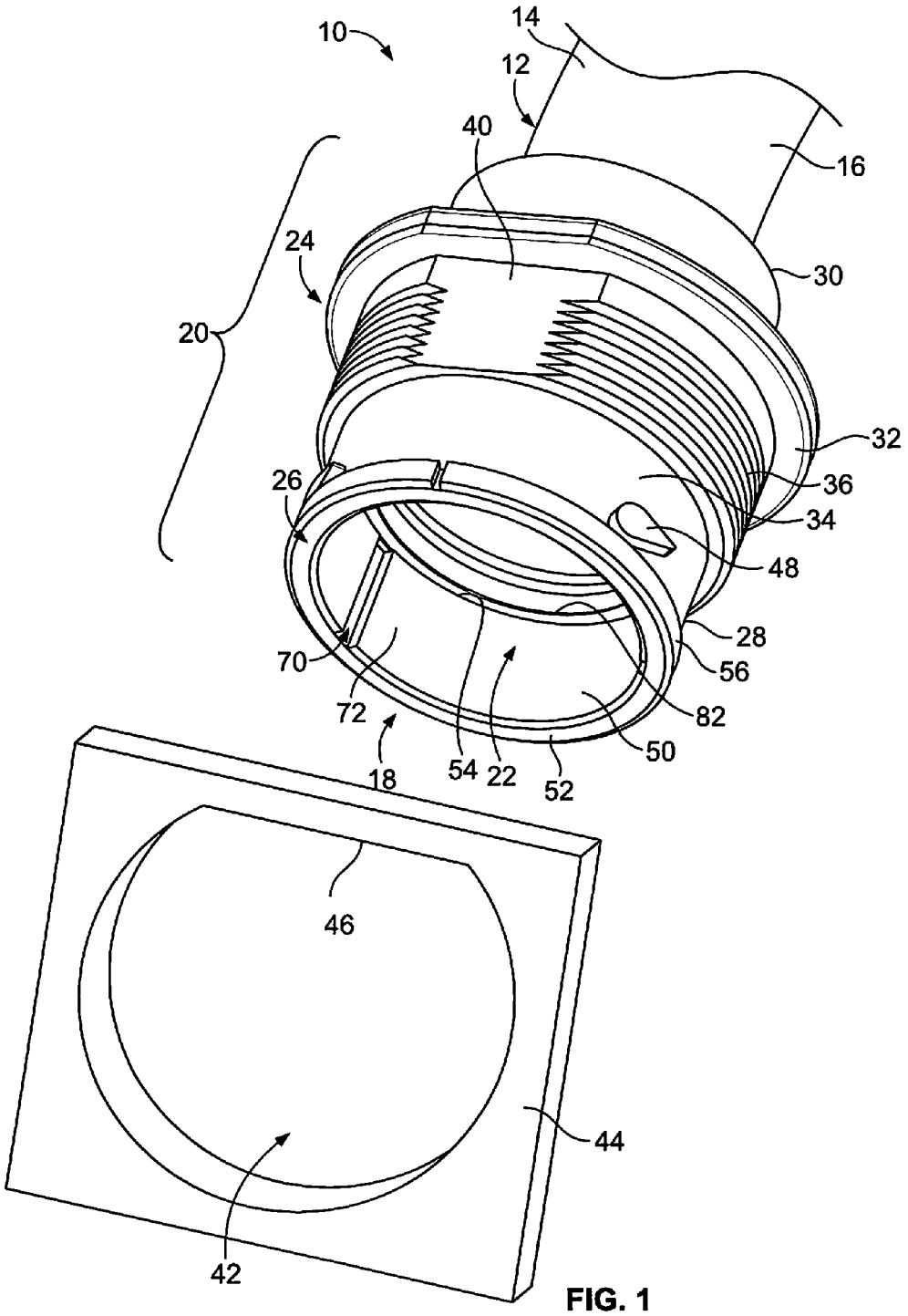
FIG. 1 is a perspective view of an embodiment of an electrical connector formed in accordance with an exemplary embodiment configured to be attached to a panel.
Figure 2:
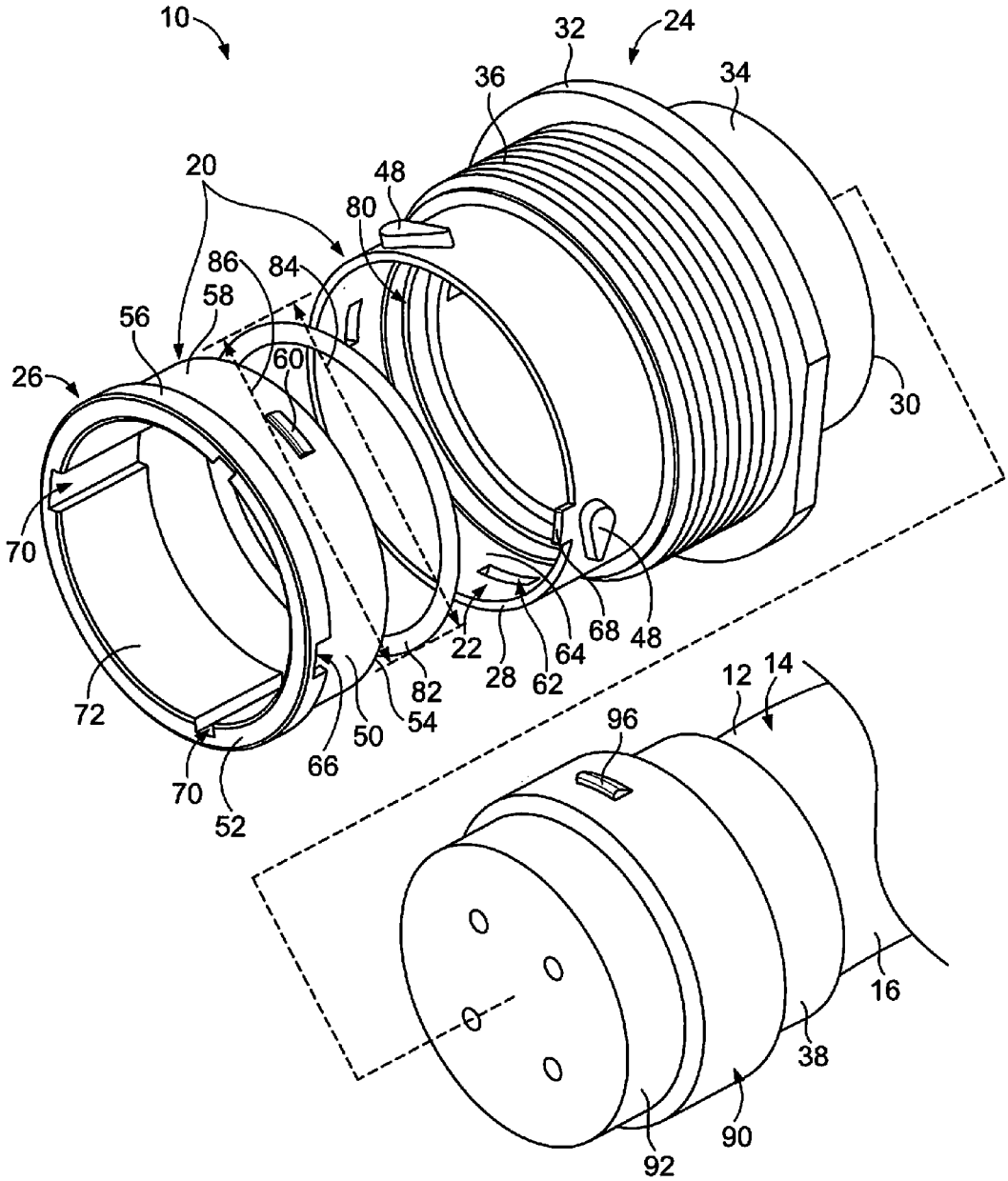
FIG. 2 is a partially exploded perspective view of the electrical connector.

FIG. 1 is a perspective view of an embodiment of an electrical connector 10. FIG. 2 is a partially exploded perspective view of the electrical connector 10. Referring now to FIGS. 1 and 2, the electrical connector 10 is configured to electrically connect to one or more electrical wires (not shown) at an end 12 of a cable 14. The electrical wires may be arranged within a jacket 16 of the cable 14. In alternative embodiments, the electrical connector 10 may be terminated to a circuit board rather than being terminated to a cable 14.

In the illustrated embodiment, the electrical connector 10 is configured to mate with a complementary electrical connector (not shown). Specifically, the electrical connector 10 includes a mating interface 18 at which the electrical connector 10 is configured to mate with the complementary electrical connector such that an electrical connection is established between the electrical connector 10 and the complementary electrical connector. The mating interface 18 may additionally or alternatively include any other configuration, arrangement, and/or the like (e.g., plug, receptacle, threaded connection, and/or the like) than is shown and/or described herein.

The electrical connector 10 includes a housing 20 that extends along a longitudinal axis. The housing 20 defines a cavity 22 or receptacle configured to receive the complementary electrical connector, which in an exemplary embodiment is a plug connector. In an exemplary embodiment, the housing 20 is a multi-piece housing defined by a rear receptacle housing 24 and a front receptacle housing 26. The rear receptacle housing 24 may be defined by a shell and may be referred to hereinafter as shell 24. The front receptacle housing 24 may be defined by a seal retainer and may be referred to hereinafter as seal retainer 26.

The shell 24 extends a length along the central longitudinal axis from a front or mating end 28 to a rear or cable end 30. The mating end 28 of the shell 24 may define a portion of the mating interface 18. Alternatively, the seal retainer 26 may be positioned forward of the front end 28 and define the mating interface 18. The electrical connector 10 terminates the cable 14 such that the cable 14 extends from the cable end 30 of the shell 24. The shell 24 may include a panel flange 32 extending from an exterior surface 34 of the shell 24. The panel flange 32 may be located near the rear end 30. The panel flange 32 may be located elsewhere along the shell 24, such as approximately centered between the front end 28 and the rear end 30 or near the front end 28. The electrical connector 10 may include external threads 36 along the exterior surface 34, such as forward of the panel flange 32. The external threads 36 may be used to threadably couple a panel nut to the shell 24 to secure the electrical connector 10 to a panel 44. The electrical connector 10 may optionally include a gland seal 38 at the rear end 30. The gland seal 38 facilitate sealing the interface between the shell 24 and the cable 14, and specifically the electrical wires, at the rear end 30 of the shell 24. The gland seal 38 may provide strain relief for the wires.

In the illustrated embodiment, the shell 24 of the electrical connector 10, and thus the electrical connector 10 overall, has an approximately circular form factor. For example, a cross-section taken approximately perpendicularly to the central longitudinal axis 22 has an approximately circular shape, as should be apparent from FIGS. 1 and 2. In other words, and for example, the shell 24 of the electrical connector 10 has an approximately cylindrical shape between the ends 28 and 30. The shell 24 may not have a uniform cylindrical shape along the longitudinal axis 22 as the shell 24 may include the panel flange 32, external threads 36 or other features. For example, optionally, the shell 24 may include at least one flat 40 (FIG. 1) along the external surface 34. The flat 40 may be used to orient the electrical connector 10 within an opening 42 in a panel 44 (both shown in FIG. 1). For example, the opening 42 may be D-shaped with the flat 40 fitting along a flat edge 46 of the opening 42 to resist rotation of the electrical connector 10 within the panel 44. The shell 24 may include securing features 48 for securing the plug connector to the electrical connector 10. For example, the securing features 48 may be bayonet-style lugs extending outward from the exterior surface 34. Other types of securing features 48 may be provided in alternative embodiments. The securing features 48 may be provided near the front end 28. The electrical connector 10 is not limited to the circular form factor shown herein.

The seal retainer 26 includes a ring shaped body 50 having an approximately cylindrical form factor. The seal retainer 26 extends between a front edge 52 and a rear edge 54. In an exemplary embodiment, the seal retainer 26 includes a front flange 56 at the front edge 52. The front flange 56 extends radially outward from an exterior surface 58 of the seal retainer 26. The seal retainer 26 includes one or more securing features 60 used to secure the seal retainer 26 to the shell 24. In the illustrated embodiment, the securing features 60 are latches; however, other types of securing features 60 may be used in alternative embodiments. The shell 24 includes securing features 62 that interact with the securing feature 60 to secure the seal retainer 26 to the shell 24. In the illustrated embodiment, the securing features 62 are slots formed in an interior surface 64 of the shell 24. A portion of the seal retainer 26 is received in the cavity 22 such that the securing features 60 engage the securing features 62. For example, the seal retainer 26 may be loaded into the cavity 22 until the front flange 56 abuts against the front end 28 of the shell 24.

In an exemplary embodiment, the seal retainer 26 includes a pocket 66 in the front flange 56. The pocket 66 defines a keying feature, which may be referred to herein after as keying feature 66, for orienting the seal retainer 26 relative to the shell 24. The shell 24 includes an orientation feature 68 that interacts with the keying feature 66 to orient the seal retainer 26 relative to the shell 24. In the illustrated embodiment, the orientation feature 68 is a tab or protrusion extending forward from the front end 28. The tab is configured to be received in the pocket 66. Optionally, multiple keying features 66 and orientation features 68 may be provided for orienting the seal retainer 26 relative to the shell 24.

The seal retainer 26 includes one or more orientation features 70 used to orient the mating of the plug connector with the electrical connector 10. In the illustrated embodiment, the orientation features 70 are grooves formed in an interior surface 72 of the seal retainer 26. The grooves extend longitudinally along the interior surface 72. Optionally, the grooves may have different widths for keyed mating of the plug connector with the electrical connector 10. The orientation features 70 may be arranged at any angular positions along the interior surface 72. Optionally, the orientation features 70 may be positioned at different angular positions for keyed mating of the plug connector with the electrical connector 10. For example, three orientation features 70 may be provided, with two of the orientation features 70 being oriented at approximately 110° from another of the orientation features 70 such that the two orientation features 70 are positioned 140° from each other. Other orientations are possible in alternative embodiments.

In an exemplary embodiment, the shell 24 has a circumferential channel 80 in the cavity 22 proximate to the front end 28. The channel 80 may be defined by one or more walls of the shell 24. The channel 80 is configured to receive an O-ring seal 82 therein. The seal retainer 26 is used to retain the O-ring seal 82 in the channel 80. For example, the O-ring seal 82 may be captured between walls of the channel 80 and the rear edge 54 of the seal retainer 26. The O-ring seal 82 has a diameter 84 sized to fit in the cavity 22. The diameter 84 may be approximately equal to a diameter 86 of the seal retainer 26 at the rear edge 54. As such the seal retainer 26 may he aligned with the O-ring seal 82 in the cavity 22 for holding the O-ring seal 82 in the shell 24. The O-ring seal 82 may seal against the interior surface 64 of the shell 24. The O-ring seal 82 may seal against the plug connector when the plug connector is loaded into the cavity 22. The O-ring seal 22 may seal against other components in alternative embodiments, such as against a contact assembly 90.

Figure 10:
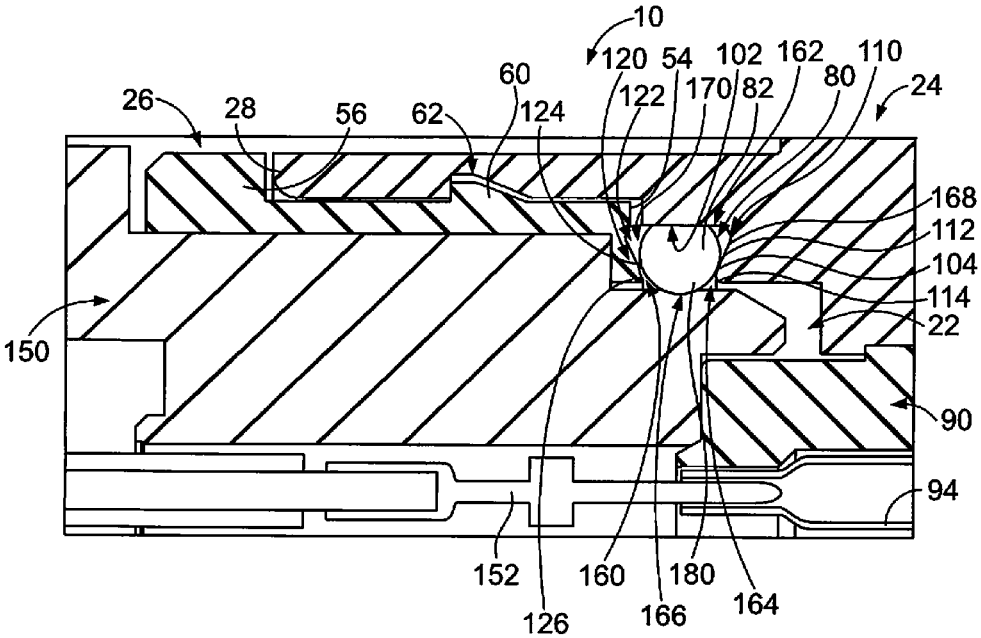
FIG. 10 is a cross-sectional view of a portion of the electrical connector in an assembled state showing a plug connector at least partially received in the shell.

The contact assembly 90 includes a holder 92 holding one or more contacts 94 (shown in FIG. 10). The contacts 94 are configured to electrically connected with plug contacts 152 (shown in FIG. 10) of the plug connector 150 (shown in FIG. 10). The contacts 94 may be any types of contacts, such as socket contacts, pin contacts, spring contacts, deflectable beam contacts, and the like. The contact assembly 90 is received in the cavity 22 and holds the contacts 94 for mating with the plug connector. The contact assembly 90 may be secured in the shell 24 by securing features 96. The securing feature may be a keyway, a latch or another type of securing feature. The contact assembly 90 may be loaded through the rear end 30 such that the securing features 96 engage corresponding securing features (not shown) of the shell 24 to secure and/or orient the contact assembly 90 with respect to the shell 94. In an alternative embodiment, rather than having a separate contact assembly 90 loaded into the shell 24, the contact assembly may be an integral part of the shell 24. For example, the holder 92 may be an integral part of the shell 24 and include contact channels that receive the contacts 94.

Figure 3:
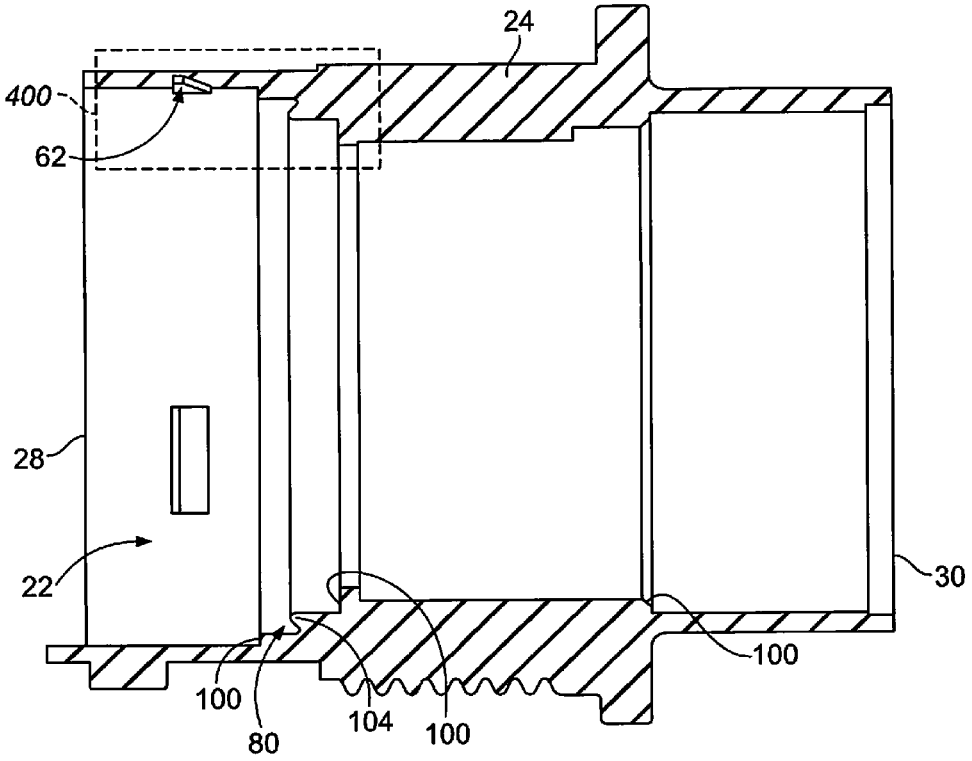
FIG. 3 is a cross-sectional view of a shell of the electrical connector formed in accordance with an exemplary embodiment.
Figure 4:
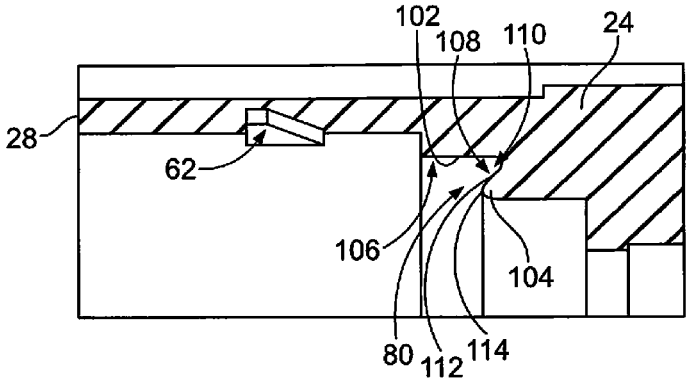
FIG. 4 is an enlarged view of a portion of the shell identified by an area in FIG. 3.

FIG. 3 is a cross-sectional view of the shell 24 showing the cavity 22 extending longitudinally between the front end 28 and the rear end 30. FIG. 4 is an enlarged view of a portion of the shell 24 identified by the area 400 in FIG. 3. The shell 24 includes one or more shoulders 100 defining steps within the cavity 22. The steps vary the thickness of the shell 24 along the longitudinal axis. The shoulders 100 may be used to orient the contact assembly 90 (shown in FIG. 2) and/or the seal retainer 26 (shown in FIGS. 1 and 2) within the cavity 22. For example, the shoulder 100 may define stop surfaces for the contact assembly 90 and/or the seal retainer 26 to limit loading of the contact assembly 90 and/or seal retainer 26 in the cavity 22. One or more of the shoulders 100 may define the channel 80 of the shell 24. The securing features 62 are provided forward of the channel 80 for securing the seal retainer 26 in the shell 24.

With particular reference to FIG. 4, the channel 80 is defined by a circumferential outer wall 102 and a seal retention flange 104. The outer wall 102 is defined along a radially outer side 106 of the channel 80 and the seal retention flange 104 is provided along a rear side 108 of the channel 80. In an exemplary embodiment, the seal retention flange 104 defines an undercut 110 in the channel 80. The undercut 110 provides a space for the O-ring seal 82. The seal retention flange 104 includes an angled wall 112 that extends to a distal edge 114. The angled wall 112 defines the undercut 110. The distal edge 114 is provided at a radially inner end of the channel 80. The distal edge 114 of the seal retention flange 104 extends outward over a portion of the channel 80 such that, when the O-ring seal 82 (shown in FIG. 2) is received in the channel 80, the seal retention flange 104 holds or blocks the O-ring seal 82 in the channel 80. The distal edge 114 may be curved or rounded so as to not damage the O-ring seal 82. The seal retention flange 104 transitions to the outer wall 102 along a curved or rounded path. The angled wall 112 and the outer wall 102 form an acute angle therebetween. Optionally, the angle wall 112 may be angled at approximately 60°.

In an exemplary embodiment, the shell 24 is molded or cast. For example, the shell 24 may be injection molded or die-cast. The mold or die used to form the channel 80 of the shell 24 may be straight-pulled from the cavity 22. For example, the mold or die may be a straight-pull mold or a straight-pull die configured to be straight pulled from the front end 28. The mold or die may thus easily form the outer wall 102 and the seal retention flange 104, including the angled wall 112 and distal edge 114, without the need for a collapsible core mold or die. Collapsible core molds and dies have problems with flashing at the seams where the mold or die pieces meet. Flashing leads to many problems, including partially filling of the channel space, causing the O-ring seal 82 to sit improperly in the shell 24. Additionally, forming the undercut using collapsible core molds or dies would be difficult and would require an expensive mold or die. In contrast, the shell 24 may be manufactured with a straight-pull mold or a straight-pull die, which is simple, cost effective and may easily form the undercut 110.

Figure 5:
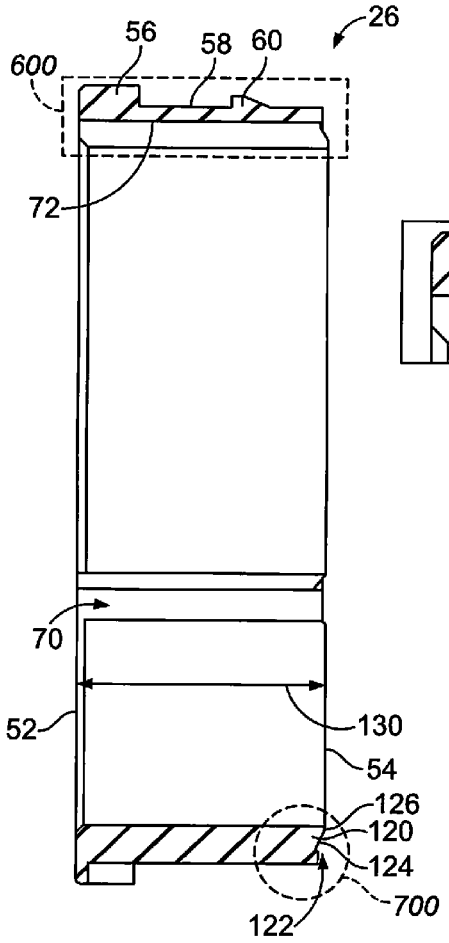
FIG. 5 is a cross-sectional view of a seal retainer of the electrical connector formed in accordance with an exemplary embodiment.
Figure 6:
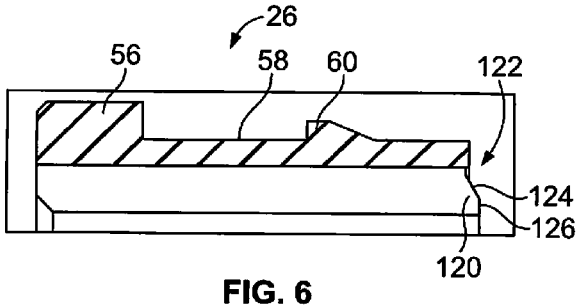
FIG. 6 is an enlarged view of a portion of the seal retainer identified by an area in FIG. 5.
Figure 7:
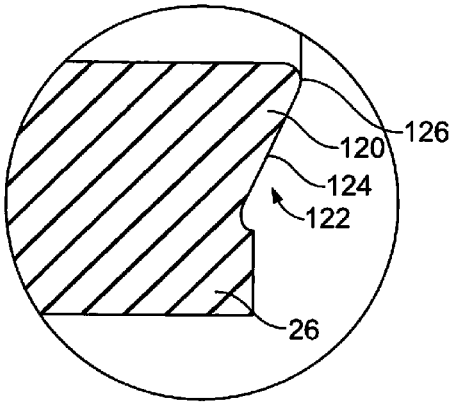
FIG. 7 is an enlarged view of a portion of the seal retainer identified by an area in FIG. 5.
Figure 8:
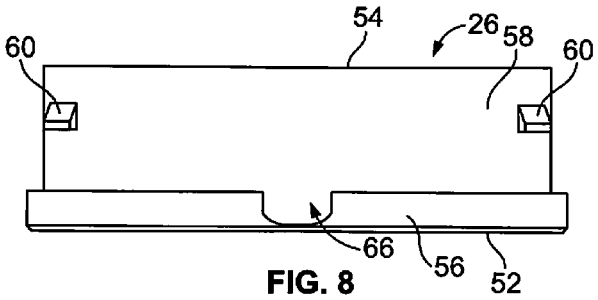
FIG. 8 is a bottom view of the seal retainer.
Figure 9:
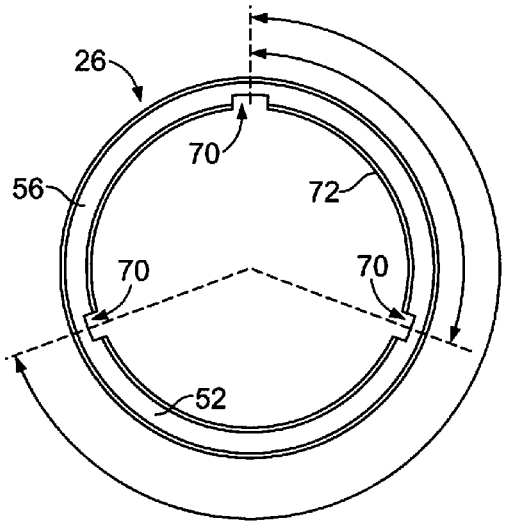
FIG. 9 is a front view of the seal retainer.

FIG. 5 is a cross-sectional view of the seal retainer 26. FIG. 6 is an enlarged view of a portion of the seal retainer 26 identified by the area 600 in FIG. 5. FIG. 7 is an enlarged view of a portion of the seal retainer 26 identified by the area 700 in FIG. 5. FIG. 8 is a bottom view of the seal retainer 26. FIG. 9 is a front view of the seal retainer 26.

The front flange 56 is provided at the front edge 52 of the seal retainer 26. The orientation features 70 are grooves extending between the front edge 52 and rear edge 54. In the illustrated embodiment, one of the grooves is provided at the top of the seal retainer 26 and the other two grooves are oriented approximately 110° from the top groove. The top groove is wider than the other two grooves to provide keyed mating for the plug connector. The securing features 60 extend from the exterior surface 58. The pocket 66 is formed in the front flange 56.

In an exemplary embodiment, the seal retainer 26 includes a seal retention flange 120 at the rear edge 54. The seal retention flange 120 extends circumferential around the seal retainer 26. The seal retention flange 120 defines an undercut 122 radially outward of the seal retention flange 120. The seal retention flange 120 includes an angled wall 124 that extends to a distal edge 126. The distal edge 126 is provided at a radially inner end of the seal retention flange 120, such as at the interior surface 72. The undercut 122 is provided radially outward of the angled wall 124 and distal edge 126. In an exemplary embodiment, the seal retainer 26 has a longitudinal length 130 defined between the front edge 52 and the rear edge 54. The length 130 is longer at the interior surface 72 than at the exterior surface 58. For example, the undercut 122 shortens or narrows the length 130. Optionally, the angled wall 124 may be angled at approximately 60°; however other angles are possible in alternative embodiments.

FIG. 10 is a cross-sectional view of a portion of the electrical connector 10 in an assembled state showing a complementary connector 150, such as a plug connector 150, at least partially received in the cavity 22. The seal retainer 26 is coupled to the shell 24 such that the O-ring seal 82 is captured by the seal retainer 26 and shell 24. The securing feature 60 of the seal retainer 26 is received in the securing feature 62 of the shell 24 to secure the seal retainer 26 to the shell 24. The front flange 56 is positioned forward of the front end 28. The plug connector 150 is plugged into the electrical connector 10 through the seal retainer 26 into the shell 24. In an exemplary embodiment, the O-ring seal 82 seals against a portion of the plug connector 150.

When the seal retainer 26 is plugged into the shell 24 the rear edge 54 is aligned with the channel 80. Optionally, at least a portion of the seal retainer 26 may be received in the channel 80. The seal retainer 26 is positioned in the shell 24 such that the seal retention flange 120 faces the seal retention flange 104 of the shell 24 across the channel 80 to define a seal pocket 160. The seal pocket 160 extends circumferentially around the cavity 22. Optionally, the seal pocket 160 may be a dovetail or dovetail-shaped. The O-ring seal 82 is received in the seal pocket 160 and is captured in the seal pocket 160 by the seal retention flanges 104, 120.

The seal pocket 160 is defined, at least in part, by the channel 80. The seal pocket 160 is bounded at a radially outer end 162 by the circumferential outer wall 102 of the shell. The seal pocket 160 is bounded at a rear end 168 by the angled wall 112 of the seal retention flange 104. The seal pocket 160 is bounded at a front end 170 by the angled wall 124 of the seal retention flange 120 of the seal retainer 26. The seal pocket 160 is bounded at a radially inner end 164 by the seal retention flanges 104, 120. An opening 166 between the seal retention flanges 104, 120 is provided at the radially inner end 164 of the sealed pocket 160. At least a portion of the O-ring seal 82 extends through the opening 166 to seal against the plug connector 150. The seal pocket 160 has a first width between the seal retention flanges 104, 120 at the radially outer end 162 and a second width between the seal retention flanges 104, 120 at the radially inner end 164. The second width is defined between the distal edges 114, 126. The second width is narrower than the first width. The second width is narrower than the diameter 84 of the O-ring seal 82 such that the O-ring seal 82 is captured in the seal pocket 160 by the seal retention flanges 104, 120. In an exemplary embodiment, the seal pocket 160 has a frusto-conical cross-section with the radially outer end 162 being wider than the radially inner end 164.

A portion of the O-ring seal 82 extends radially inward of the seal pocket 160 through the opening 166 between the seal retention flanges 104, 120 for sealing engagement with the plug connector 150. For example, a sealing portion 180 of the O-ring seal 82 extends into the cavity 22 for sealing to the plug connector 150. The sealing portion 180 may seal against other components in alternative embodiments, such as the contact assembly 90 (shown in FIG. 2).

Optionally, the O-ring seal 82 may be compressible and may be compressed into the seal pocket 160 when mated with the plug connector 150. The undercuts 110, 122 may provide a space for the O-ring seal 82 to compress in the seal pocket 160.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a shell having a cavity configured to receive a complementary connector through a front end of the shell, the shell having a rear end, the shell having a circumferential channel in the cavity proximate to the front end, the channel having an undercut defined by a seal retention flange extending circumferentially around the channel; and a seal retainer received in the cavity at the front end of the shell, the seal retainer having a securing feature securing the seal retainer to the shell, the seal retainer having a front edge and a rear edge, the rear edge of the seal retainer being aligned with the channel, the rear edge of the seal retainer having an undercut defined by a seal retention flange, wherein the seal retention flange at the rear edge of the seal retainer faces the seal retention flange of the shell across the channel to define a seal pocket;

an O-ring seal received in the seal pocket, the O-ring seal being held in the seal pocket by the seal retention flanges.

2. The electrical connector of claim 1, wherein the channel is defined by a circumferential outer wall along a radially outer side of the channel and the seal retention flange of the shell along a rear side of the channel.

3. The electrical connector of claim 1, wherein the seal retention flange of the shell defines a rear side of the channel, the seal retention flange of the shell including an angled wall defining the undercut of the shell.

4. The electrical connector of claim 1, wherein the seal retention flange of the shell includes a distal edge angled outward over a circumferential outer wall of the channel to form the undercut of the shell.

5. The electrical connector of claim 1, wherein the seal pocket is bounded at a radially outer end by a circumferential outer wall, the seal pocket being defined at a radially inner end by the seal retention flanges and an opening between the seal retention flanges.

6. The electrical connector of claim 1, wherein the seal pocket has a first width between the seal retention flanges at a radially outer end and the seal pocket has a second width between the seal retention flanges at a radially inner end, the second width being narrower than the first width, the second width being narrower than a diameter of the O-ring seal.

7. The electrical connector of claim 1, wherein the seal pocket has a frusto-conical cross-section with a radially outer end being wider than a radially inner end.

8. The electrical connector of claim 1, wherein the O-ring seal extends radially inward of the seal pocket through an opening between the seal retention flanges.

9. The electrical connector of claim 1, wherein the shell has a generally cylindrical cross-section.

10. The electrical connector of claim 1, wherein the seal retainer has a ring shaped body having a diameter at the rear edge approximately equal to a diameter of the O-ring seal.

11. The electrical connector of claim 1, wherein the O-ring seal is captured between the seal retainer and the seal retention flange of the shell such that a sealing portion of the O-ring seal extends into the cavity for sealing.

12. The electrical connector of claim 1, wherein the shell includes a panel flange extending radially outward from an exterior surface of the shell, the shell being configured to pass through an opening in a panel such that the panel flange engages the panel.

13. The electrical connector of claim 1, wherein the shell includes external threads along an exterior surface of the shell.

14. The electrical connector of claim 1, wherein the securing feature comprises a latch, the shell having a slot in an interior surface of the shell, the slot receiving the latch to secure the seal retainer in the cavity.

15. The electrical connector of claim 1, wherein the shell includes an orientation feature and the seal retainer includes a keying feature interfacing with the orientation feature to orient the seal retainer with respect to the shell.

16. The electrical connector of claim 1, wherein the seal retainer includes an orientation feature configured to orient the complementary connector with respect to the shell.

17. The electrical connector of claim 1, further comprising a contact assembly received in the cavity, the contact assembly including a holder holding the contact.

18. An electrical connector comprising:

a shell having a cavity configured to receive a contact assembly including at least one contact, the shell having a generally cylindrical cross-section and extending between a front end and a rear end, the shell configured to receive a complementary connector through the front end, the shell having an internal channel in the cavity proximate to the front end, the internal channel having a circumferential outer wall along a radially outer side of the channel and a seal retention flange along a rear side of the channel, the seal retention flange being angled to define an undercut between the seal retention flange and the outer wall; and a seal retainer received in the cavity at the front end of the shell, the seal retainer having a securing feature securing the seal retainer to the shell, the seal retainer having a ring-shaped body extending to a rear edge, the rear edge being received in the channel such that the rear edge faces the seal retention flange across the channel to define a seal pocket; and an O-ring seal received in the seal pocket, the O-ring seal being held in the seal pocket by the rear edge and the seal retention flange.

19. An electrical connector comprising:

a shell defining a rear receptacle housing extending between a front end and a rear end, the rear receptacle housing having a cavity configured to receive a complementary connector through the front end, the rear receptacle housing having a generally cylindrical cross-section;

a seal retainer defining a front receptacle housing received in the cavity at the front end of the shell, the front receptacle housing having a securing feature securing the front receptacle housing to the rear receptacle housing, the front receptacle housing having a ring-shaped body extending to a rear edge;

wherein the rear receptacle housing and front receptacle housing form a seal pocket therebetween, the seal pocket being positioned radially outward of the cavity, the seal pocket having seal retaining flanges formed by undercuts; and an O-ring seal received in the seal pocket, the O-ring seal being held in the seal pocket by the seal retention flanges.

* * * * *